United States Patent [19]

Yoneyama

[11] Patent Number: 4,667,963

[45] Date of Patent: May 26, 1987

[54] GOLF CLUB HEAD

[75] Inventor: Minoru Yoneyama, Niigata, Japan

[73] Assignee: Yonex Kabushiki Kaisha, Niigata, Japan

[21] Appl. No.: 786,308

[22] Filed: Oct. 10, 1985

[30] Foreign Application Priority Data

Mar. 18, 1985 [JP] Japan ..... 60-37396[U]

[51] Int. Cl.[4] ..... A63B 53/04

[52] U.S. Cl. ..... 273/169; 273/78

[58] Field of Search ..... 273/167 F, 169, 167 R, 273/167 A, 167 J, 78, 170, 171, 172, 175, 168

[56] References Cited

U.S. PATENT DOCUMENTS

| | | | |
|---|---|---|---|
| 1,222,770 | 4/1917 | Kaye | 273/167 J |
| 1,257,471 | 2/1918 | Fitzjohn et al. | 273/167 F |
| 2,040,252 | 5/1936 | Farrington | 273/78 |
| 2,174,212 | 9/1939 | Newsome | 273/78 |
| 2,429,351 | 10/1947 | Fetterolf | 273/78 |
| 2,447,967 | 8/1948 | Stone | 273/167 F |
| 2,530,446 | 11/1950 | Beardsley | 273/168 |
| 2,859,972 | 11/1958 | Reach | 273/164 |
| 3,025,061 | 3/1962 | Ernst et al. | 273/82 |
| 3,140,094 | 7/1964 | Hings | 273/167 F X |
| 3,218,072 | 11/1965 | Burr | 273/78 |
| 3,220,733 | 11/1965 | Saleeby | 273/171 |
| 3,266,805 | 8/1966 | Bulla | 273/167 F X |
| 3,815,910 | 6/1974 | Raines | 273/80 C |
| 3,937,474 | 2/1976 | Jepson et al. | 273/173 |
| 4,027,885 | 6/1977 | Rogers | 273/167 F X |
| 4,506,888 | 3/1985 | Nardozzi, Jr. | 273/80.1 |
| 4,534,558 | 8/1985 | Yoneyama | 273/78 |

FOREIGN PATENT DOCUMENTS

| | | | |
|---|---|---|---|
| 692197 | 8/1964 | Canada | 273/167 R |
| 59-82060 | 6/1984 | Japan | 273/78 |
| 59-102061 | 7/1984 | Japan | 273/169 |
| 59-102062 | 7/1984 | Japan | 273/78 |
| 1201648 | 8/1970 | United Kingdom | 273/167 R |
| 1293767 | 10/1972 | United Kingdom | 273/DIG. 23 |

OTHER PUBLICATIONS

Yonex, "Carbonex 22", Golf Digest, 12/83 issue, pp. 47, 273–Dig. 7.

*Primary Examiner*—George J. Marlo

*Attorney, Agent, or Firm*—Wenderoth, Lind & Ponack

[57] ABSTRACT

A golf club head includes a sole formed of metal material such as soft iron, stainless steel, and the like; a hosel for receiving a shaft therein and formed of metal material integrally with the sole; a filler member having a specific gravity of 5 to 7 and formed by mixing fiber reinforced resin material with weighty material, the filler member having a substantially triangular shape in cross section and secured to the sole; and a fiber reinforced resin layer having a substantially inverted V shape in cross section, the layer being fitted over and enclosing the filler member, and lower marginal edges of the layer being substantially flush with upper edges of the sole.

4 Claims, 3 Drawing Figures

GOLF CLUB HEAD

BACKGROUND OF THE INVENTION

The present invention relates to the head structure of golf clubs and, more particularly, to an improvement in the head structure of iron clubs.

In general, iron clubs are intended primarily for second, third and bunker shots rather than tee shots, and they are used often for hitting shots from the bare ground, a sandy place and so on as well as from turf. Accordingly, conventional iron clubs are designed so that the club head is made in one body from a metallic material such as soft iron, stainless steel or the like in order to prevent the club head, and in particular its sole, from being readily damaged by a pebble or sand when hitting a ball.

The metal material, however, does not permit variety in the design of such clubs because of its large specific gravity. For example, it is desirable particularly for beginners and powerless golfers that the center of gravity of the head is located at a relatively lower part thereof. This is achieved by increasing the thickness of the lower part of the club head including the sole, but the thickness of middle and upper portions of the head should be reduced in order to maintain the weight of the head as a standard level, such reduced thickness resulting in the defect of decreased distance of a struck ball. Thus, it has been believed with conventional iron clubs that good operability and high performance are not compatible with each other. Further, the face surface of the conventional head is made of a hard metal, and hence its repulsive force is small. Accordingly, the use of hard metal is not always preferable from the viewpoints of the direction and distance of the ball.

Recently, there has been proposed a golf club head comprising a metal core and a fiber reinforced resin layer enclosing the core as, for example, disclosed in Japanese laid-open document No. 59-82060. This type of golf club head has the merits of permitting variety of design thereof because the volume of metal material is rather small, and of achieving a greater distance because of its large repulsive force at the striking face, as compared with the conventional type. The metal core behind the striking face, however, unfavorably affects the feel when hitting the ball, and tends to cause the ball to take off from the face immediately after a short period of impact, this being undesirable for direction of the ball. Further, since the core and the enclosing layer are formed of entirely different materials, it is difficult to connect them together by an adhesive and there is the possibility that the enclosing layer may peel off from the core. In addition, an upwardly extended metal core prevents the center of gravity from being positioned at a considerably lower part of the head to the satisfaction of non-expert golfers.

SUMMARY OF THE INVENTION

It is therefore an object of the present invention to provide a golf club head which can achieve both longer hitting distance and stabler direction than conventional club heads.

Another object of the present invention is to provide a golf club head which may permit variety in the design thereof so as to achieve both good operability and high performance simultaneously.

A further object of the present invention is to provide a golf club head with improved, soft feel for impact.

According to the invention, a golf club head comprises: a sole formed of metal material such as soft iron, stainless steel, and the like; a hosel for receiving a shaft therein and formed of the metal material integrally with the sole; a filler member having a specific gravity of 5 to 7 and formed by mixing fiber reinforced resin material with weighty material, the filler member having a substantially triangular shape in cross section and secured to the sole; and a fiber reinforced resin layer having a substantially reverse or inverted V shape in cross section, the layer being fitted over and enclosing said filler member, and lower marginal edges of the layer being substantially flush with upper edges of the sole.

The weighty material may be of powered heavy metal such as powdered lead, tungsten and the like.

Preferably, the sole has formed on its upper surface a rib extending in a longitudinal direction of the sole from a heel portion to a toe portion, the rib being embedded in the filler member.

In one embodiment of the present invention, the thickness of the sole is gradually increased towards the back of the club head by inclining the upper surface of the sole.

The reinforcing fiber in the layer is preferably long carbon fiber.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
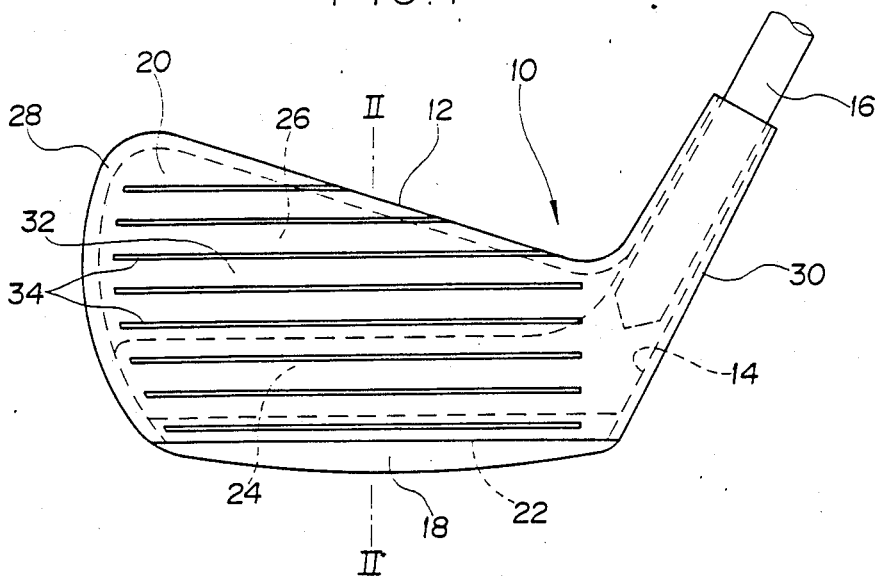
FIG. 1 is a front elevation illustrating a golf club head according to a preferred embodiment of the present invention.
Figure 2:
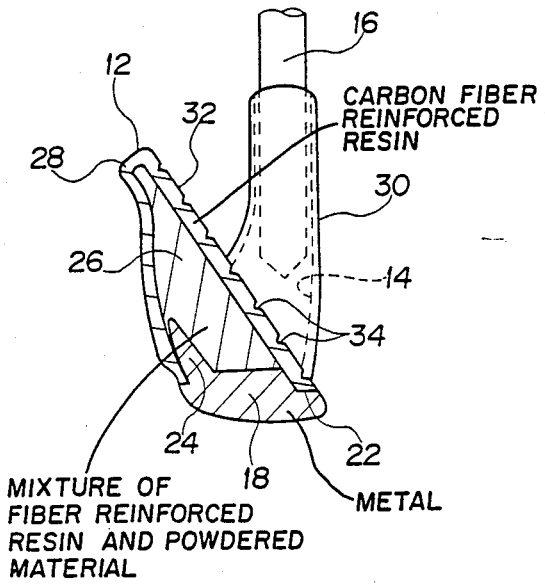
FIG. 2 is a sectional view of the golf club head taken along lines II—II in FIG. 1.

Referring to FIGS. 1 and 2 of the drawings, a golf club head 10 according to a first embodiment is illustrated to have a frontal contour similar to those of conventional iron club heads and comprises a head body 12 and a hosel 14 for receiving a shaft 16 therein. The head body 12 includes a sole 18 which is formed of metal material such as soft iron, stainless steel, brass, bronze, or like material and with which the hosel 14 of the metal material is integrally connected at a heel portion of the head body 12. The sole 18 is provided at its front edge with a shoulder 22 and on its upper surface with a rib 24 which is integral with the sole 18 and extends in a longitudinal direction of the sole 18 from a heel portion to a toe portion of the head body 12. In the illustrated embodiment, the rib 24 is formed near the back of the head and has a substantially triangular shape defined by a base integral with sole 18 and front and rear surfaces converging upwardly to the upper end of rib 24.

Securely fixed on the sole 18 is a filler member 26 which has a triangular cross sectional shape, i.e. a shape with a thicker-base and a narrower top, and in which the rib 24 is embedded to prevent the filler member 26 from being separated from the sole 18. The filler member 26 is formed by mixing fiber reinforced resin material with weighty material so that it has a specific gravity of 5 to 7, as hereinafter described. The bottom face of the filler member 26 is slightly smaller than the upper surface of the sole 18 so as to permit lower marginal edges of an enclosing layer 28 to be substantially flush with the upper edges of the sole 18. The enclosing layer 28 is formed of fiber reinforced resin, preferably of carbon fiber reinforced resin material which is formed of long carbon fibers suitably woven and impregnated with resin material.

The layer 28 has a substantially inverted V shape in cross section and is fitted over and encloses the entirety of the filler member 26, while in the illustrated embodiment a tubular extension 30 is integrally formed with the enclosing layer at the heel portion and covers the hosel 14 so that the portion of the club head formed of metal material is visible only at the sole 18. A plurality of grooves 34 are formed on the striking face 32 of layer 28 for imparting a spin to the ball.

Figure 3:
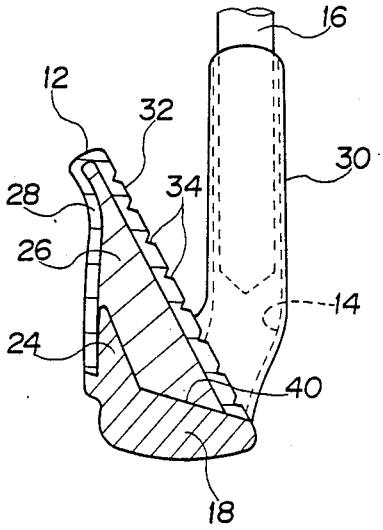
FIG. 3 is a view similar to FIG. 2 illustrating another embodiment of the invention.

The sole 18 may have a thickness gradually increasing towards the back of the head body 12 with an inclined upper surface 40, as illustrated in FIG. 3.

The matrix for the filler member 26 is preferably epoxy resin or polyester resin and may be reinforced with carbon fiber, glass fiber, silicon carbide whisker or the like. The weighty material to be mixed in the reinforced resin preferably comprises powdered material having a large specific gravity. Although powder of non-metallic ore or ceramics may be employed as the weighty material, powdered heavy metals are preferable and the most preferable materials are powdered lead (specific gravity 11.3) and powdered tungsten (specific gravity 19.3). The specific gravities of the resin and reinforcing fiber are 1.0–1.2 and 1.7–2.7, respectively, and by mixing the reinforced resin with the above weighty materials in a suitable manner the filler member 26 having the specific gravity of 5 to 7 can be formed. In this embodiment, resin, reinforcing fiber, lead powder and tungsten powder are mixed in the ratio 10:5:4:2 by volume.

In the golf club head thus formed, the small volume of metal material permits variety in a design thereof in respect to both its form and weight. For example, it is possible to maintain the center of gravity of the head at a relatively lower part thereof while maintaining a sufficient thickness at the upper portion of the head to avoid decreasing the distance of a struck ball. Particularly, modification of the head weight is easily attained by changing the mixing ratio of the materials forming the filler member 26 to thereby change the specific gravity thereof. If, however, this specific gravity is in excess of 7, the weight of the filler member 26 becomes practically the same as conventional metal materials so that less variety in a design results and feel in hitting the ball is unfavorably effected due to an increased amount of the weighty material. On the other hand, if the filler member is formed to have the specific gravity less than 5, it becomes necessary to unacceptably increase the width of the head in order to maintain a normal balance of the club. Therefore, the specific gravity of the filler member 26 should be in the range of 5 to 7.

The hitting face 32 formed of the fiber reinforced resin layer has a larger repulsive force and higher elasticity than those of conventional iron clubs, so that a longer hitting distance of a struck ball can be achieved, which is especially remarkable when long carbon fibers are used as a reinforcing fiber. Further, since the filler member 26 inside this fiber reinforced resin layer is mainly formed of the fiber reinforced resin, feel in hitting the ball can be improved and the impact period of time with the ball will increase, which will result in good control and stable direction of the ball, and easily imparting a backspin to the ball.

During the molding of the club head 10, the layer 28 is unitarily adhered to the filler member 26, as if they were a one-piece molding, because both include the resin material. Therefore, possibility that the layer 28 will come off from the filler member 26 can be ignored even after a long period of use, thus ensuring a long life of the head. The sole 18 is made of metal as is the case with conventional clubs, and hence is not likely to be damaged by pebbles, sand or the like, for example, in hitting a shot from bare ground.

The filler member 26 may be fixed to the sole 18 by a suitable adhesive, and the rib 24 on the sole 18 as in the illustrated embodiment may be used to further strengthen the joint between the filler member 26 and the sole 18.

Although the present invention has been described with reference to the preferred embodiments thereof, many modifications and alterations may be made within the spirit of the invention.

What is claimed is:

1. A golf club head of the iron type and comprising:

a sole formed of a metal material;

a hosel for receiving a shaft therein and formed of said metal material integrally with said sole;

a rib formed on an upper surface of said sole integrally therewith, said rib extending from a heel portion to a toe portion of the golf club head along the longitudinal direction of said sole;

a filler member having a specific gravity of 5 to 7 and formed by a mixture of fiber reinforced resin material with weighty material, said filler member having a cross-sectional shape with a wider base and a narrower apex, said filler member being integrally fixed over said sole with said rib being embedded within said filler member, a lower end of said filler member having a thickness in a direction of swing of the head smaller than the thickness of said sole to provide front and rear shoulders therebetween; and a fiber reinforced resin layer having a substantially inverted V-shape in cross section, said layer being fitted over and enclosing said filler member, said layer and said filler member being bonded together during the molding thereof, and lower marginal edges of said layer being substantially flush with upper edges of said sole at said shoulders.

2. A golf club head as claimed in claim 1, wherein said weighty material comprises powdered heavy metal such as powdered lead, tungsten and the like.

3. A golf club head as claimed in claim 1, wherein said sole has a thickness gradually increasing towards the back of the head and an inclined upper surface.

4. A golf club head as claimed in claim 1, wherein the reinforcing fiber of said fiber reinforced resin layer comprises long carbon fiber.

* * * * *